US005621935A

United States Patent [19]

St. Clair

[11] Patent Number: 5,621,935

[45] Date of Patent: Apr. 22, 1997

[54] METHOD AND APPARATUS FOR PROVIDING IMPROVED POCKETED INNERSPRING CONSTRUCTIONS

[75] Inventor: Albert R. St. Clair, Lilburn, Ga.

[73] Assignee: Simmons Company, Atlanta, Ga.

[21] Appl. No.: 302,417

[22] Filed: Sep. 8, 1994

[51] Int. Cl.[6] ..... A47C 27/04

[52] U.S. Cl. ..... 5/720; 5/655.8

[58] Field of Search ..... 5/477, 475, 720, 5/655.8

[56] References Cited

U.S. PATENT DOCUMENTS

| | | | |
|---|---|---|---|
| 685,160 | 10/1901 | Marshall | 5/477 |
| 1,284,384 | 11/1918 | Lewis | 5/477 |
| 3,230,558 | 1/1966 | Duncan | 5/477 |
| 4,234,983 | 11/1980 | Stumpf | 5/477 |
| 4,234,984 | 11/1980 | Stumpf | 5/477 |
| 4,401,501 | 8/1983 | Stumpf | 156/367 |
| 4,439,977 | 4/1984 | Stumpf | 53/428 |
| 4,451,946 | 6/1984 | Stumpf | 5/477 |
| 4,523,344 | 6/1985 | Stumpf et al. | 5/477 |
| 4,566,926 | 1/1986 | Stumpf | 156/165 |
| 4,578,834 | 4/1986 | Stumpf | 5/477 |
| 4,854,023 | 8/1989 | Stumpf | 29/91 |
| 4,907,309 | 3/1990 | Breckle | 5/477 |
| 5,016,305 | 5/1991 | Suenens | 5/477 |

*Primary Examiner*—Michael J. Milano

*Attorney, Agent, or Firm*—Jones, Day, Reavis & Pogue

[57] ABSTRACT

An innerspring construction comprises a first elongate string of pocketed coil springs with each coil having a longitudinal axis lying in a first plane and a first elongate tube of fabric having first transverse seams spaced along the length of the tube to define individual coil spring pockets. The tube is alternately bent proximate the first seams such that every other first seam lies on the same side of the first plane. A second elongate string of pocketed coils in which each coil has a longitudinal axis lying in a second plane has a second elongate tube of fabric with second transverse seams spaced along the length of the tube to define individual coil pockets. The second elongate string is attached to the first elongate string by bonds formed between circumferentially abutting surfaces on the coil pockets of the first and second tubes of fabric. The resulting construction provides for reduced tendency for leaning coils and permits greater innerspring firmness for a given coil wire diameter.

17 Claims, 10 Drawing Sheets

OPERATOR PANEL

SET-UP PANEL

METHOD AND APPARATUS FOR PROVIDING IMPROVED POCKETED INNERSPRING CONSTRUCTIONS

BACKGROUND OF THE INVENTION

1. Field of the Invention

This invention relates to methods and apparatus for providing improved innerspring constructions for mattresses, box springs, cushions or other bedding items. Particularly, the invention relates to methods and apparatus for producing improved pocketed coil innerspring construction, which due to the orientation of individual pocketed coil strings within the innerspring construction exhibit improved physical properties. The invention also relates to innerspring constructions per se.

2. Description of Related Art

In the bedding industry, it is well known to provide mattresses having innerspring constructions. One type of innerspring construction is the "Marshall"-type, in which coil springs are pocketed within fabric to create finite lengths or "strings" of pocketed coils. The coil spring pockets may be defined by sewing transverse and longitudinal seams, or may be formed by the use of ultrasonic thermal welding as disclosed in U.S. Pat. Nos. 4,234,983 and 4,234,984 to Stumpf which are produced and incorporated herein by reference. Such strings of pocketed coils may be produced by the use of pocketing machines such as those disclosed in U.S. Pat. Nos. 4,439,977 and 4,854,023 to Stumpf which are incorporated herein by reference. Such pocketed strings may be assembled to create innerspring constructions such as shown in U.S. Pat. Nos. 4,401,501, 4,578,834 or 4,566,926, all incorporated herein by reference.

Although satisfactory innerspring constructions are provided utilizing the methods and apparatus taught in the above-referenced patents, improved methods and apparatus for producing such products are required. Particularly, a need exists to provide innerspring constructions, as well as a methods and apparatus for creating such constructions, which exhibit improved dimensional stability and structural integrity while enabling greater innerspring and mattress firmness for a particular spring wire diameter.

SUMMARY OF THE INVENTION

The present invention provides improvements over the prior art by providing improved innerspring constructions and methods and apparatus for producing such constructions. The innerspring constructions according to the present invention exhibit improved properties such as dimensional stability and structural integrity, even immediately after the hot melt assembly operation. The methods and apparatus according to the present invention further result in products which exhibit a reduced tendency for "leaning coils", and permit greater innerspring and mattress firmness for a given wire diameter, while still permitting improved tailoring and improved finished product appearance.

Therefore, it is an object of the present invention to provide improved innerspring construction, for use in mattresses, box springs, cushions, or the like.

It is a further object of the present invention to provide improved methods and apparatus for producing innerspring constructions.

It is a further object of the present invention to provide innerspring constructions which exhibit improved dimensional stability.

It is a further object of the present invention to provide innerspring constructions which exhibit improved structural integrity.

It is a further object of the present invention to provide innerspring constructions which are firmer than prior art constructions for a particular wire diameter.

It is a further object of the present invention to provide innerspring constructions which permit improved tailoring and finished product appearance.

It is a further object of the present invention to provide innerspring constructions which results in limited formation of body depressions upon use.

It is a further object of the present invention to provide efficient and effective methods and apparatus for manufacturing innerspring constructions.

It is a further object of the present invention to provide apparatus for manufacturing innerspring constructions which are simple to maintain.

It is a further object of the present invention to provide methods and apparatus for manufacturing innerspring constructions which are simple to control.

It is a further object of the present invention to provide methods and apparatus for manufacturing innerspring constructions which are adaptable for use in manufacturing a wide variety of innerspring constructions.

It is a further object of the present invention to provide methods and apparatus for manufacturing innerspring constructions which are economical to operate and maintain.

It is a further object of the present invention to provide apparatus for manufacturing innerspring constructions which are safe to operate and maintain.

Other objects, features, and advantages of the present invention will become apparent upon reading the following detailed description of the preferred embodiment of the invention when taken in conjunction with the drawing and the appended claims.

DETAILED DESCRIPTION OF PREFERRED EMBODIMENTS

Figure 1:
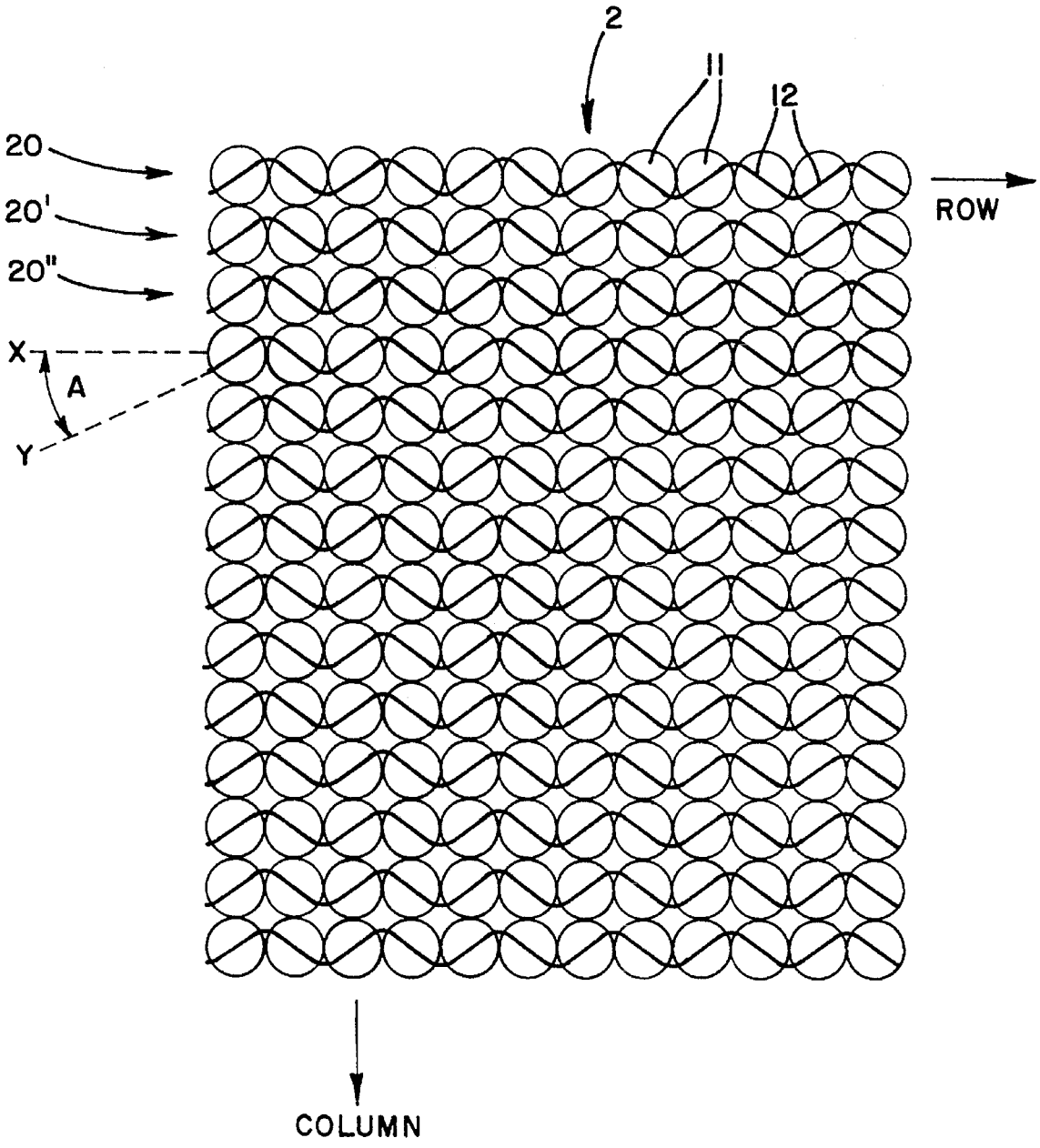
FIG. 1 is a top plan view of an innerspring construction according to the present invention with the top or "longitudinal" seams of adjacent rows of pocketed spring coils aligned in a chevron-like inverted V configuration and with adjacent ones of the pocketed coils in the rows arranged for attachment in a "belly to belly" manner (i.e., individual coil pockets in a first row are attached directly to adjacent individual coil pockets in an adjacent second row).

Reference is now made to FIGS. 1–13, in which like numerals designate like elements throughout the several views.

Generally, the present invention relates to innerspring constructions such as those, designated by the reference numeral 2 in FIGS. 1–4, 12 and 13. This invention also relates to methods for producing innerspring constructions 2 such as the preferred method illustrated in FIGS. 5A–5D. Additionally, the present invention is directed to apparatus, designated generally by the numeral 10, for use in producing innerspring constructions 2 such as the apparatus illustrated in FIGS. 6–11.

Referring now to FIGS. 1–4, it should be noted that strings 20, 20', and 20" of pocketed coils 11 are aligned in adjacent Rows and are assembled together to form part of an innerspring construction 2, which may be provided with border wires and upholstery as known in the art to create an innerspring mattress. When installed, each string of coils 20 is aligned generally along a string plane "X", best illustrated in FIG. 1, with the longitudinal axes of the individual spring coils 11 lying substantially within such plane X. As shown in FIG. 1, the strings of coils 20 also include longitudinal, outwardly-extending, top seams 12. The top seams 12 of the pocketed coils 11 in each row of coil strings 20 are offset in a "zig-zag" fashion so that the "seam plane" Y of each particular individual pocketed coil 11 is at an angle "A" to the string plane X of its associated string. In one preferred embodiment, this angle A is approximately 30 degrees. Other angles are contemplated without departing from the spirit and scope of the present invention. For purposes of this application a "seam plane" of a pocketed coil is a plane which includes the central longitudinal axis of the coil, as well as including the longitudinal axis of each of the two seams on each side of the pocketed coil.

Figure 2:
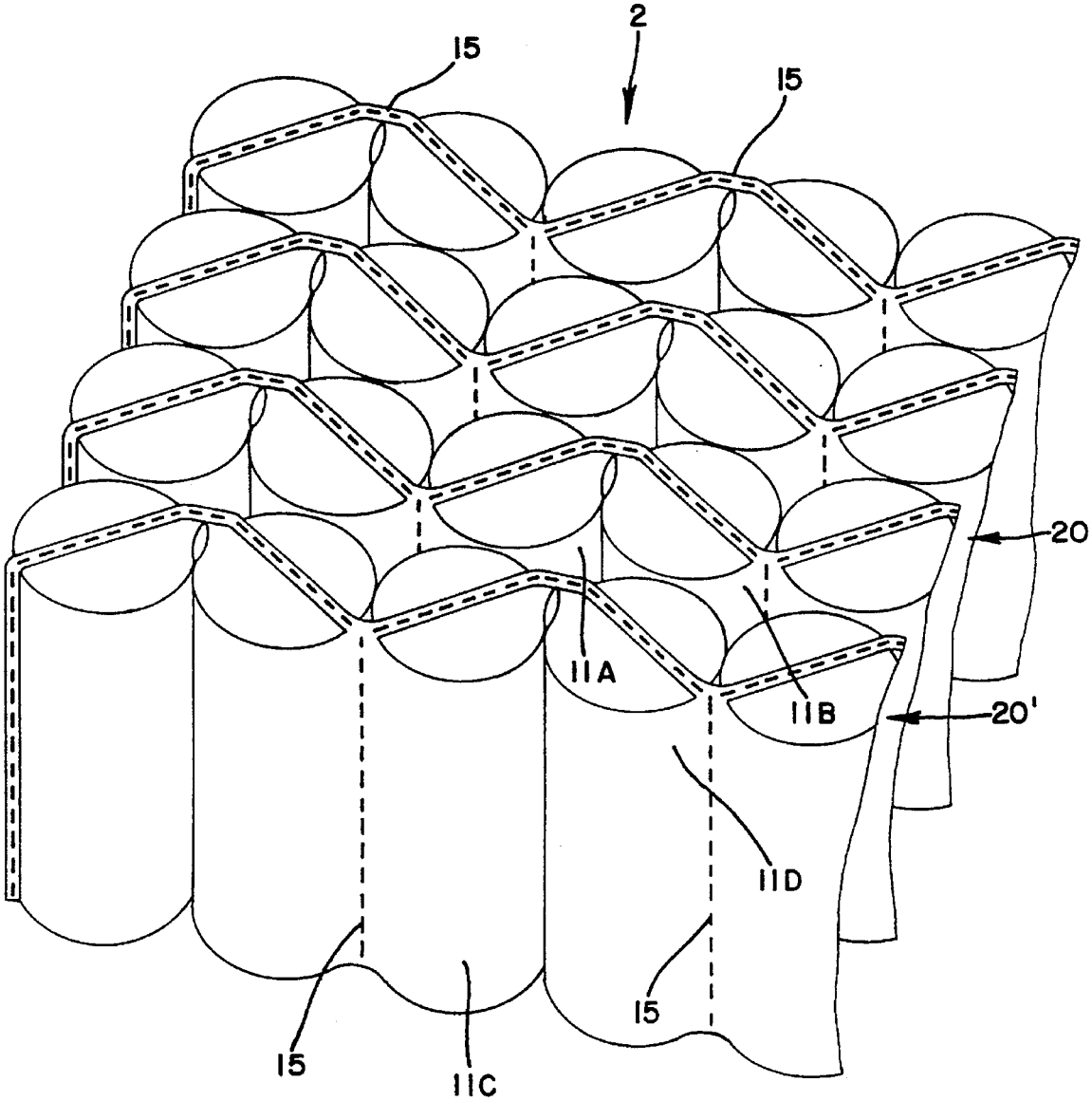
FIG. 2 is a perspective view illustrating a portion of the innerspring construction of FIG. 1.
Figure 3:
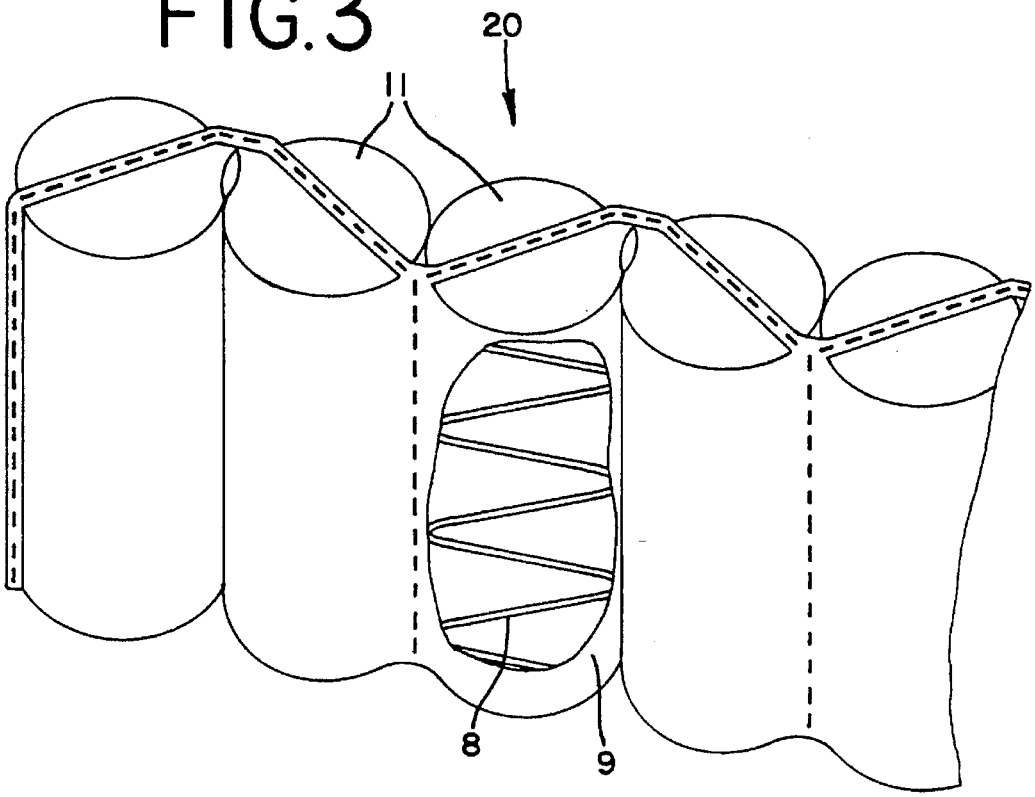
FIG. 3 is a perspective view of a single string of pocketed coils as illustrated in FIGS. 1 and 2.
Figure 4:
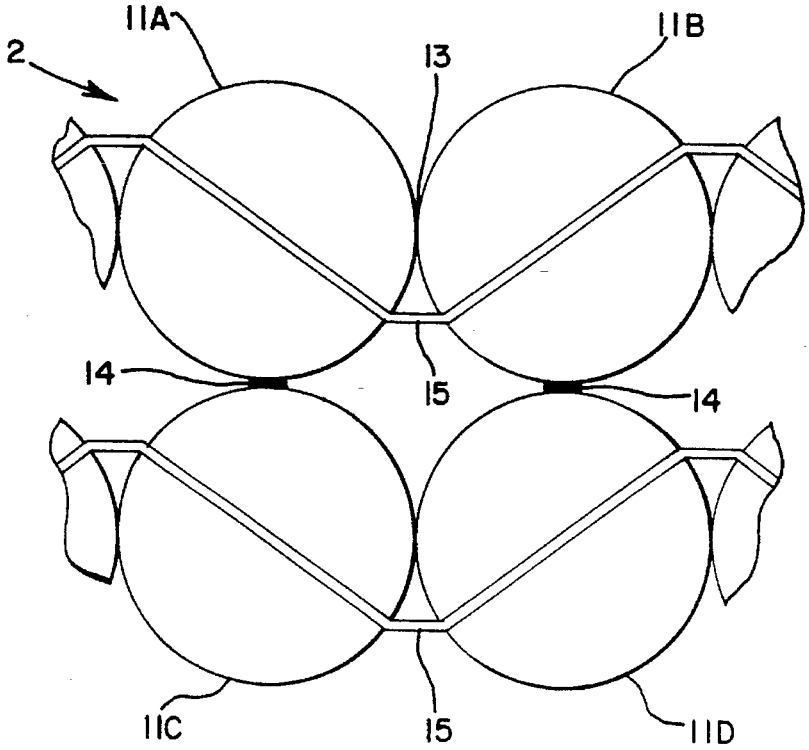
FIG. 4 is an enlarged top view of a portion of an innerspring assembly according to the present invention illustrating in detail the "belly to belly" attachment technique employed to interconnect a first string of pocketed coils to a second such string.

Referencing FIGS. 2–4, sections of an innerspring construction 2 according to the present invention are shown, which include spring coils 8 shown in FIG. 3 enclosed within pocketing material 9 to form the pocketed coils 11, such as pocketed coils 11A, 11B, 11C, and 11D best illustrated in FIGS. 2 and 4. As shown in FIG. 4, pocketed coil 11A is bonded to coil 11C which is positioned in the next adjacent Column of the next adjacent Row of the construction 2 by a "hot melt" or other suitable glue, weld or appropriate interconnecting bond 14. Pocketed coil 11B is likewise bonded to the next adjacent coil 11D in the next adjacent Column of the next adjacent Row of the construction 2 by a bond 14 formed by gluing, welding or the like. No glue or other bonding material is present at contact points such as 13 illustrated in FIG. 4. A transverse pocket seam 15 is formed between pocketed coils 11A and 11B, and another transverse pocket seam 15 is formed between pocketed coils 11C and 11D.

In the method of the present invention as best illustrated in FIGS. 5A–5D, a plurality of finite strings 20 of pocketed coils 11, are assembled to create an innerspring construction 2 which may be upholstered by techniques known in the art.

As illustrated in FIGS. 5A–5D, a string 20 of pocketed coils 11 is "snapped" into place by traversing coil roller assembly 44 and held by a plurality of generally C-shaped harp members 30 which number one more than half the number of pocketed coils 11. The coil string 20 is then urged into biasing contact with a previously-processed stationary string 20, and held in place by an appropriate bonding technique known in the art such as by gluing. The string 20 is then released from the harps 30 by a stripper plate 34 and the process is repeated.

Figure 6:
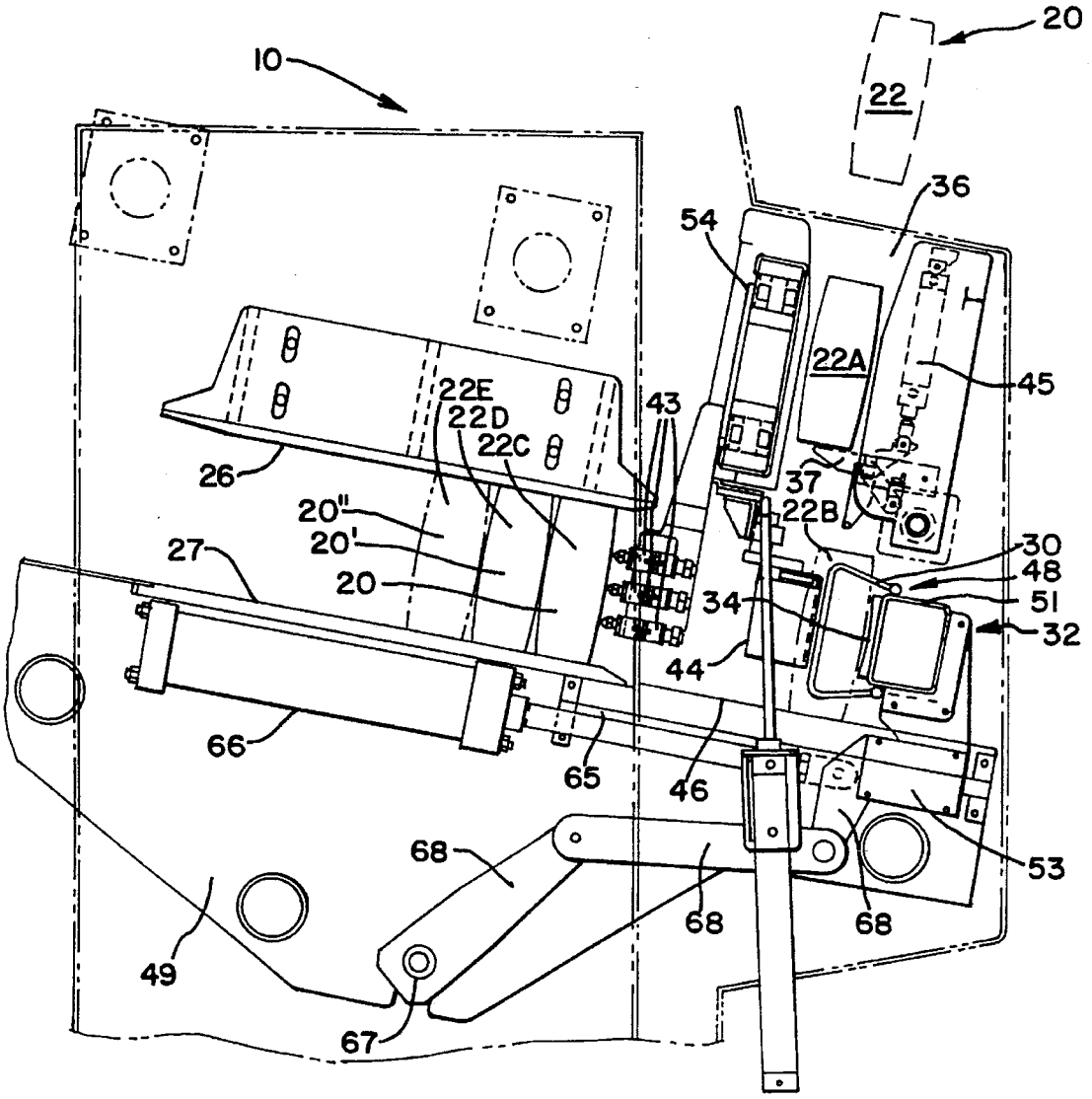
FIG. 6 is a side elevational view of an apparatus according to the present invention, which accepts coil strings and assembles them into innerspring constructions in accordance with the present invention.

As best illustrated in FIG. 6, a preferred embodiment of the apparatus 10 of the present invention can be seen for assembling coil strings 20 into an innerspring construction 2 and for bonding the strings 20 together with glue. In FIG. 6, the apparatus 10 is viewed from its left side, with the coil strings 20 being viewed from their ends, as the strings 20 travel through the apparatus 10 without a substantial change in orientation.

A coil string 20 is moved from a position 22 outside and above the apparatus 10 (shown in phantom) to a position at 22A inside an upwardly-opening loading chute 36, which is defined at its bottom by a retractable floor gate 37, which supports the weight of the string 20 at position 22A. The gate 37 is periodically pivoted out of the way from its "loading" to its "discharge" position by one or more air cylinders 45 or other means known in the art. When the gate 37 is retracted, the string 20 drops under the influence of gravity atop a slightly inclined supporting surface 46 in front of the harps 30 and in a traversing path of the coil roller assembly 44. At this point the coil string 20 is in position to be inserted into the harps 30.

The harps 30 are part of one of two harp assemblies 48, each of which includes upper and lower mounting bars or rods 31 (seen in FIG. 7) interconnected with the harps 30. The harp assemblies 48 are rigidly but detachably mounted to a pusher bar assembly 32. Two harp assemblies 48 are used so that the harp assemblies may be more easily manipulated by the operator during the changeover process described later.

Referring now to FIGS. 5A–5D and FIG. 7, the pusher bar assembly 32 is movable forwardly and rearwardly relative to the frame 49 of the apparatus 10 to bring two pocketed coil strings 20, 20' into contact for gluing. The pusher bar assembly 32 includes a frame 51 and a stripper plate 34 and is interconnected with the harp assemblies 48. The stripper plate 34 is mounted for periodic forward and rearward movement relative to the frame 51 of the pusher bar assembly 32. The forward movement of the stripper plate 34 in conjunction with rearward movement of the pusher bar assembly 32 as illustrated by arRows in FIG. 5D causes the coil string 20 to be "stripped" from the grip of the harps 30 and without impacting the bonding of adjacent coil strings such as 20' as discussed elsewhere in this application.

The coil roller assembly 44 (seen in FIGS. 5–7) is part of a traverse assembly 40 (identified in FIG. 5A and 5B), which also includes a tracking wheel cluster 42 (identified in FIG. 8), and glue applicators 43. The coil roller assembly 44 of traverse assembly 40, as illustrated in FIGS. 5A and 5B, includes a pair of rotatably mounted rollers 61 and a center face plate 62.

Figure 5A:
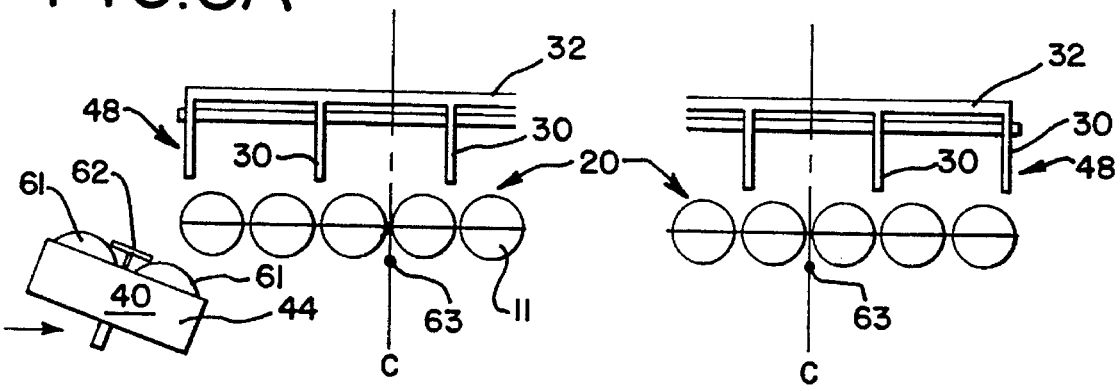
FIGS. 5A–5D are schematic views illustrating a method of manufacturing innerspring constructions according to the present invention.

As previously discussed, after dropping from the loading chute 36, a particular coil string 20 is in position in front of the harps 30 of the pusher bar assembly 34 and is in proper alignment with the substantially parallel path of the coil roller assembly 44 as best illustrated in FIG. 5A. The coil roller assembly 44 then performs its sequential snapping or "zipper" action, thus securing the coil string 20 to the harp assembly 48, such that the coil string 20 is in the position 22B in FIG. 6, which is the same position as the coil string 20 in the harp assembly 48 shown in FIG. 5B.

Figure 5B:
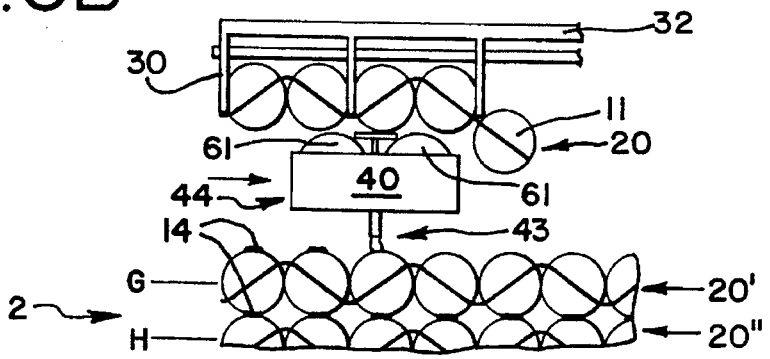

Referencing FIGS. 5A–5D and 6, a detailed explanation of an important part of the process and the apparatus for its implementation is now made. A harp assembly 48 (one of two) is indexed back and forth from a loading position as shown in FIGS. 5A and 5B to a bonding position shown in FIG. 5C. Referring now to FIG. 5A, a coil string 20 is positioned in front of the generally C-shaped harps 30 with the locating assistance of one of two retractable locating pins 63 (the other of the two locating pins being positioned at the distal end of the coil string) which extend up from a slightly inclined supporting surface 46 which supports the bottom ends of the coils 20. The supporting surface 46, preferably, is inclined at an angle of about 10 degrees from horizontal and the locating pins 63 are at an angle of about 90 degrees relative to the horizontal with an included angle of about 80 degrees relative to the support surface 46. Of course, variations in the angular configuration of parts is contemplated within the scope of this invention.

In order to assure the correct positioning of the falling coil string 20 in relation to the harps 30 at the starting end of the string 20, the retractable locating pin 63 rises from beneath the surface 46 of the apparatus 10 at an angle of 10 degrees forward of vertical relative to the surface 46. Preferably, the retractable locating pin 63 is located on a centerline C between second and third harps 30 from the starting end. The incline angle of the retractable locating pin 63 and the location of the pin 63 centered between the second and third harps 30 causes the falling spring coil 20 to be guided to a position which assures the proper starting action of the apparatus 10. As the movement of the leading edge of traverse assembly 40 approaches the next coil 11 in the coil string 20, the retractable pin 63 retracts beneath the surface 64 to avoid interference with the path of the traverse assembly 40.

As shown schematically in FIGS. 5A and 5B, a coil roller assembly 44 traverses back-and-forth alongside the harps 30 such that the coils 20 are sequentially snapped into place much like a "zipper" action and are held in place by the harps 30. It may be understood that as the individual harps 30 are fixed relative to each other and are spaced apart less than two coil diameters, the snapping action is provided by the pocketed coils 11 radially deforming and then recovering as they are forced into the grip of the harps.

As shown in FIG. 5A, the coil roller assembly 44 is at an angle prior to engaging the coil string 20. This is provided by two positioning plates, one each positioned proximate the extreme sideward positions of the traverse assembly, which "cock" the coil roller assembly to an appropriate angle. The coil roller assembly 44 is pivotably mounted relative to the traverse assembly by an appropriate bearing 78 (See FIG. 7).

As further shown in FIGS. 5A–5D, as the coils 11 are snapped forwardly into place by the rollers 61, hot-melt glue is sprayed forwardly onto a second, downstream, string of coils 20' which have already been processed by the pusher bar assembly 32.

Figure 5C:
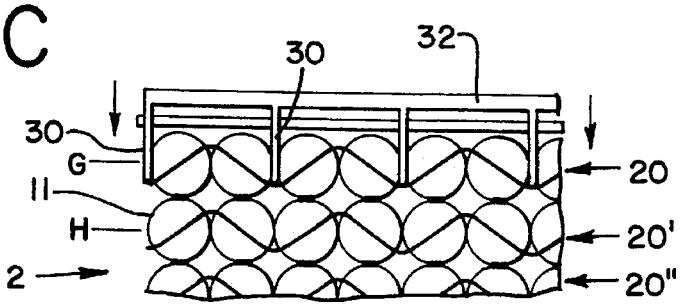

After the traverse assembly 40 has finished snapping one string 20 into place and applying glue to a second string 20', the traverse assembly 40 is moved out of the way of the pusher bar assembly 32. As shown in FIG. 5C, the first string of coils 20 is then pushed into forwardly-biased contact with the second string of coils 20' in a "belly to belly" fashion between adjacent pocketed coils 11 in adjacent Columns of adjacent Rows of coil strings 20, 20' such that a glue bond 14 is initiated as the glue sets. This bias causes the second string of coils 20' to be indexed out of the location identified by "G" in FIG. 5B to another downstream location identified as "H", and causes the first string of coils 20 to be situated at location "G" as shown in FIG. 5C. Any coil strings located further downstream of the second string (such as 20" in FIGS. 1, 12 or 13) will also be indexed rearwardly by the force of the pusher bar assembly 34. It should be understood that the first and second strings 20, 20' will eventually make up part of a finished innerspring construction such as 2 in FIGS. 1–4, 12 and 13.

One cycle of the process, under one preferred embodiment, includes loading of a first string 20 into the harps 30 with simultaneous glue application to a second string 20', pressing the two strings together, and ejecting the first string from the harps. It should be understood that for each two consecutive cycles, each of the locating pins 63 will have indexed upwardly and downwardly once.

Figure 5D:
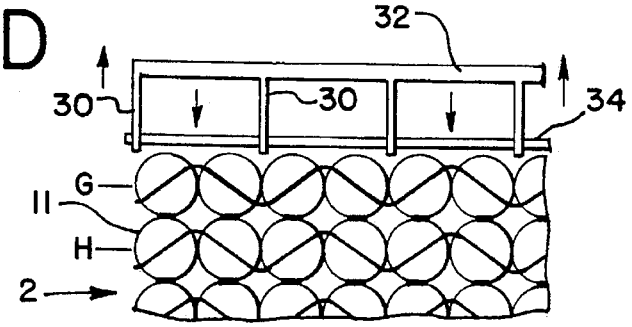

As shown in FIG. 5D, after the above-referenced indexing has occurred, the stripper plate 34 is indexed forwardly relative to the pusher bar assembly 32 to urge the first string of coils 20 out of the grasp of the harps 30. At the same time, the pusher bar assembly 32 is retracted rearwardly relative to the stationary frame 49 of the apparatus 10, such that the stripper plate 34 is substantially static and, in an embodiment of this invention, a slight bias is maintained on the first string 20 to encourage proper glue bonding. Subsequently, the pusher bar assembly 32 and its stripper plate 34 are retracted to their "loading" positions as shown in FIG. 5A. The process may then be repeated to add additional coil strings. However, in order to make maximum use of the time of the traverse assembly 40, the process is repeated in a "mirror-image" fashion, with the zipper action being initiated from an the opposite direction. In order to accomplish this result, a second locating pin 63 is located at the opposite end of the overall apparatus 10.

It is important to note that during the indexing step outlined above, the harps 30 perform a predominance of the pushing of the first string against the second string. Particularly, the substantially straight leading segments 33 (See FIG. 7) of the harps 30 are urged against every other transverse seam 15 of the coil strings 20. This is advantageous in that a "centering" action is obtained, with the harps 30 tending to seek center positions between pocketed coils 11. This centering action results in improved repeatable alignment of the pocketed coils 11 to create an improved innerspring construction 2.

Another advantage of the use of the harps 30 is that the "zig-zag" twisting of the pocketing material or fabric 9 around the spring coils 8 tends to tighten the fabric 9 around the coils 8 more tightly than when the coils strings 11 are not yet installed. This is advantageous in that there is less slack in the fabric and in the overall innerspring construction 2 such as shown in FIG. 1, which results in less play and, thus, more structural integrity and dimensional stability in the unit. The amount of tightening is variable by varying harp size for a given coil diameter.

Referring now to FIG. 6, upper and lower pressure plates 26, 27, respectively, are used to maintain integrity of the innerspring assembly 2 under construction, as the pocketed coils 11 therebetween are maintained in slight axial compression while still capable of being indexed. As shown in FIG. 6, the latest pocketed coil string 20 placed between the pressure plates 26, 27 at position 22C is the string 20 to which the glue has been applied and this string 20 at position 22C is formed adjacent strings 20' and 20" at positions 22D and 22E, respectively, to form a construction 2.

Figure 8:
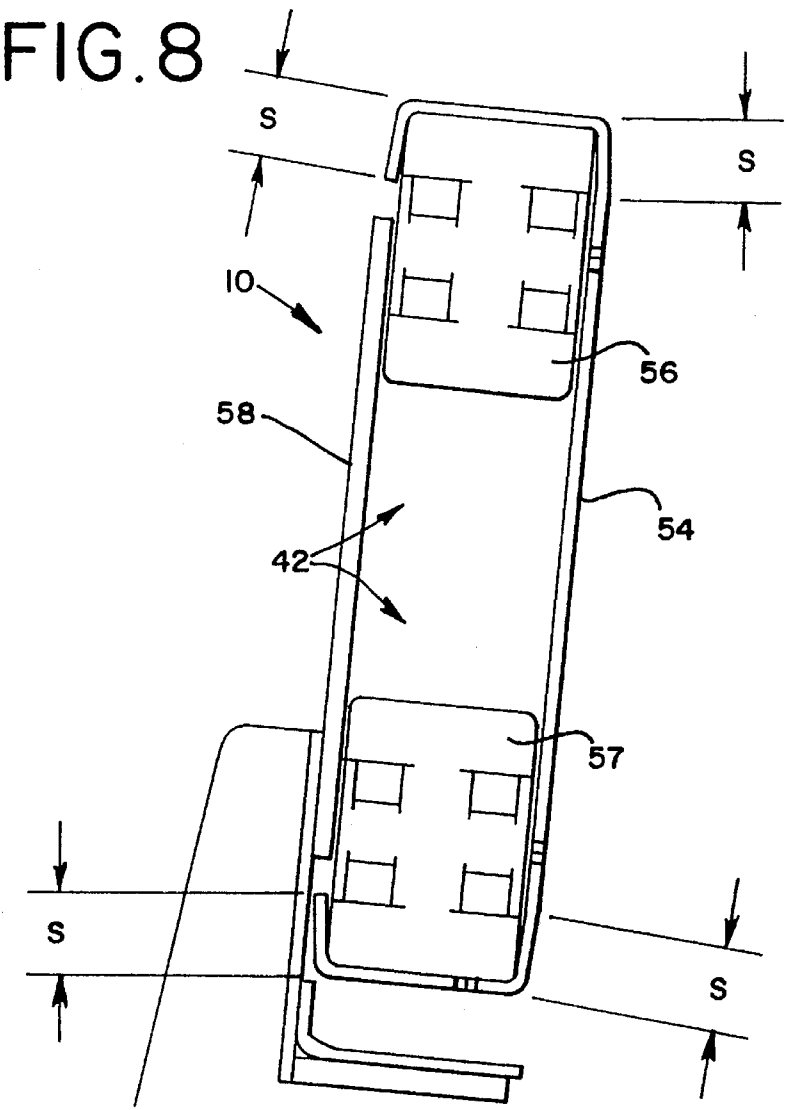
FIG. 8 is an illustrative view of a tracking assembly employed in the apparatus of FIG. 6 which is utilized for controlling movement of a traverse assembly in such apparatus.
Figure 7:
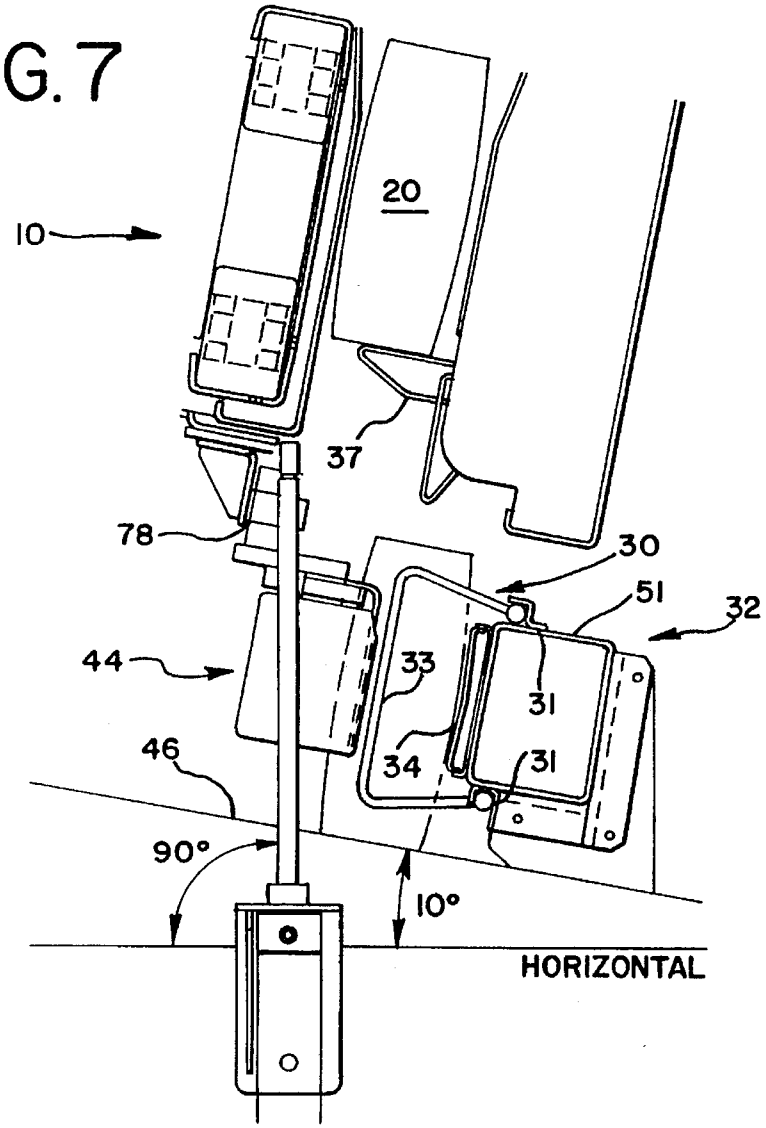
FIG. 7 is an enlarged side view of a pusher bar assembly of the apparatus illustrated in FIG. 6.

Referring now to FIG. 8, the tracking wheel cluster 42 is shown which rides within a stationary channel 54 to allow the traverse assembly 40 to be driven back and forth along its path by a belt as discussed later in this application. The channel 54 extends across and above the paths of the coils. Two pairs of rubber wheels 56, 57, are positioned within the channel 54, with the two lower wheels 57 rigidly mounted to the traverse head bracket 58, and the two upper wheels 56 spring loaded upwardly into the bracket by means known in the art. The channel 54, having a rearwardly directed opening, is rigidly mounted relative to the frame of the apparatus 10, and includes four inclined portions "S", which center the rollers and reduce their tendency to drag or bind.

The pusher bar assembly 32, best illustrated in FIG. 6, includes a pair of linear bearing blocks 53 which ride upon a pair of elongate parallel guide rods 65, which guide the assembly 34 along its linear path. The assembly 32 is driven back and forth by a pair of pneumatic cylinders 66 or other means known in the art. A torsion tube 67 having appropriate size linkage assemblies 68 provide alignment for the pusher bar assembly 32.

As previously discussed, the individual harps 30 preferably are fixed relative to each other and are spaced apart less than two coil diameters to allow for the snapping effect caused by the coil pairs deforming and then recovering as they are forced into the grip of the harps. Therefore, it may be necessary to change harps whenever coil diameter is changed. This is readily achieved by the use of known releasable latches which allow the harps to be releasably mounted relative to the pusher bar assembly. When coil diameters are changed, the center-to-center distance between the coils is also changed. Therefore, the timing of the triggering of the glue applicators will also have to be changed, as discussed later.

Figure 9:
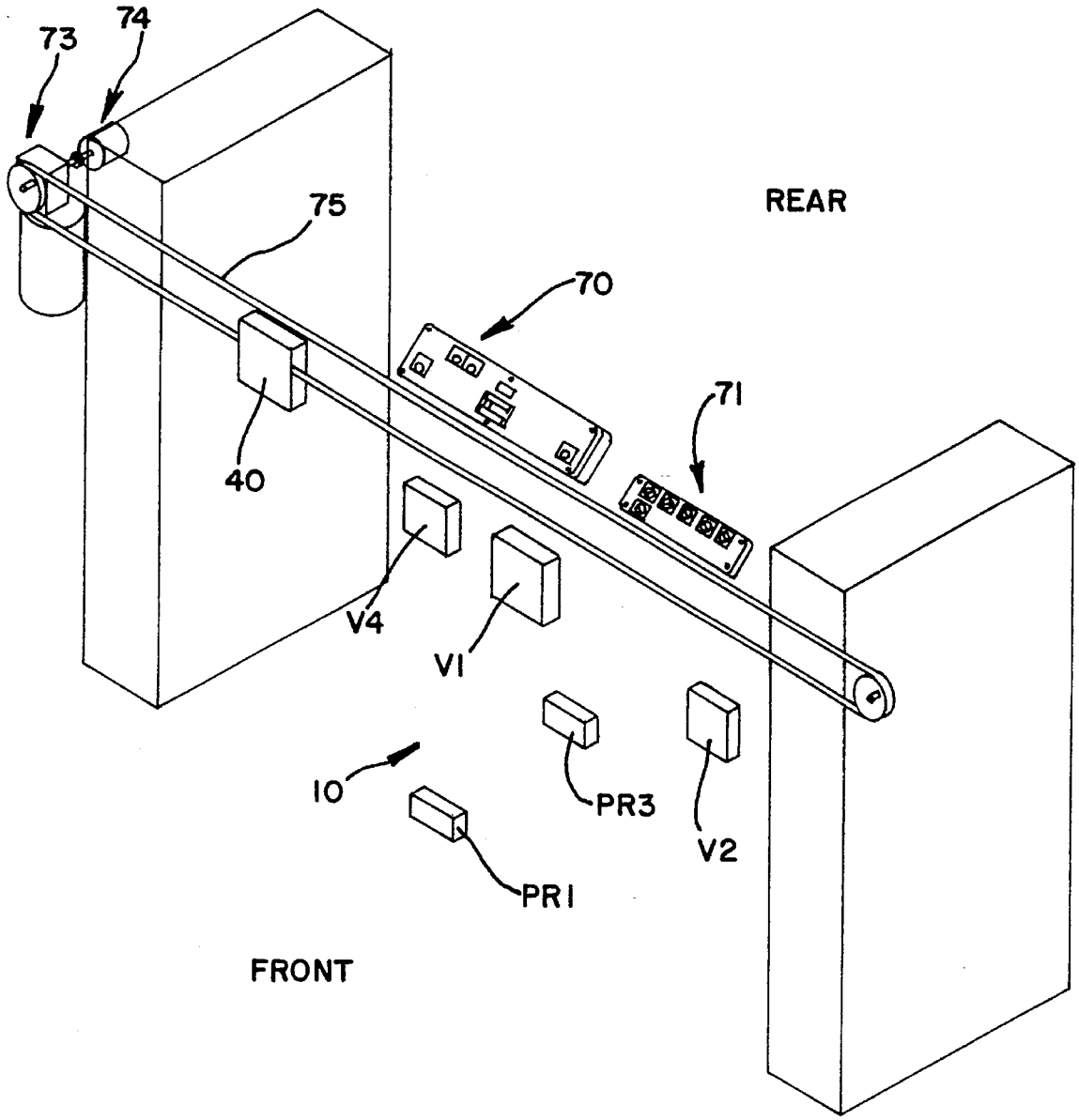
FIG. 9 is an illustrative view illustrating various control panels, switches, and other elements for use with the apparatus of FIG. 6.
Figure 10:
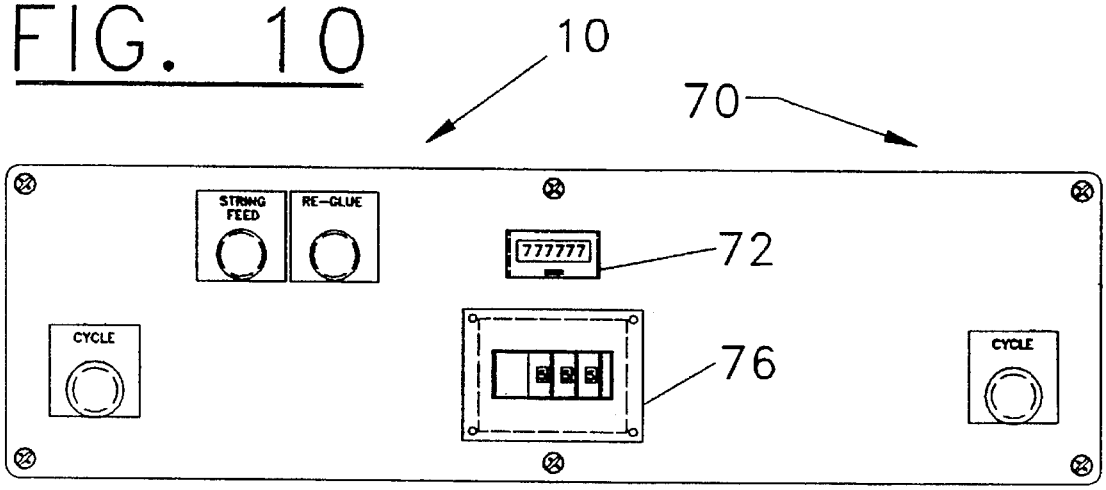
FIGS. 10 and 11 are plan views of a control panel and a set-up panel, respectively, for use with the apparatus of FIG. 6.
Figure 11:
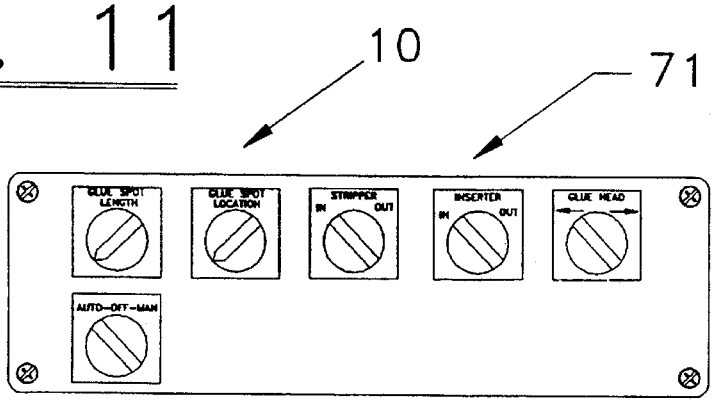

Reference is now made to FIGS. 9–11, which illustrate an operator panel 70 and a set-up panel 71, both of which allow an operator (not shown) to set up and operate the apparatus 10. FIG. 10 illustrates an operator panel 70 which allows an operator to initiate a machine cycle from either side, manually feed a string of coils 20, read the number of strings processed, or provide additional glue, if for example the machine experienced downtime after hot glue was applied. A string counter 72 is also included to show the amount of strings processed. Finally, an integer dial gauge 76 is also included to allow the operator to select from a number of preset settings corresponding to regularly used string diameters and string lengths. For example, a dial setting of "001" may correspond to a twin size, dial settings of "002" may correspond to a full size, and a dial settings of "003" and "004" may correspond to queen and king sizes, respectively.

FIG. 11 illustrates a set-up control panel 71, which allows the operator to set the glue spot lengths, glue spot locations, stripper plate "in" and "out" locations, inserter "in" and "out" locations, glue head location, and mode of operation (manual or automatic).

As previously discussed, the traverse assembly 40 is driven side-to-side along a transverse path (i.e., transverse to the travel of the coil strings within the apparatus 10) defined by rollers 44 guided by channel 54. In reference to FIG. 9, it may be seen that an electric motor/gearbox combination 73 is used to drive a flexible ribbed or notched belt 75 which is substantially continuous but for the existence of the traverse assembly 40 in line with the belt 75. The motor and gearbox assembly 73 is used to drive the belt intermittently in opposite directions such that the traverse assembly 40 is likewise driven intermittently side-to-side to perform its aforementioned duties. A rotary encoder 74 such as known in the art is provided in operable association with the belt in order to assign a particular integer value readable by a central controller, not shown) to a particular location of the traverse head. It may be understood that such information can be used to set suitable glue application locations suitable to the particular coil diameters used, and can also be used to confirm that the traverse assembly is on a particular side and ready for processing of a particular string in a particular direction.

FIG. 9 also illustrates a valve V1 which is a diverter valve which controls the movement of the pusher bar assembly by diverting air to an appropriate air cylinder such as cylinder 66 or cylinders. Valve V2 is a diverter valve which controls the movement of the stripper plate by diverting air to an appropriate air cylinder of cylinders. V4 is a valve for controlling glue flow. PR1 and PR3 are proximity switches which sense extreme forward and rearward positions of the pusher bar assembly.

In a preferred embodiment of this invention, the motor 73 and the valves V1 and V2 are controlled by appropriate microprocessors such Mitsubishi Model No. FX-32MR and the switches PR1, PR3 and rotary encode 74 provide signals to such microprocessor.

Figure 12:
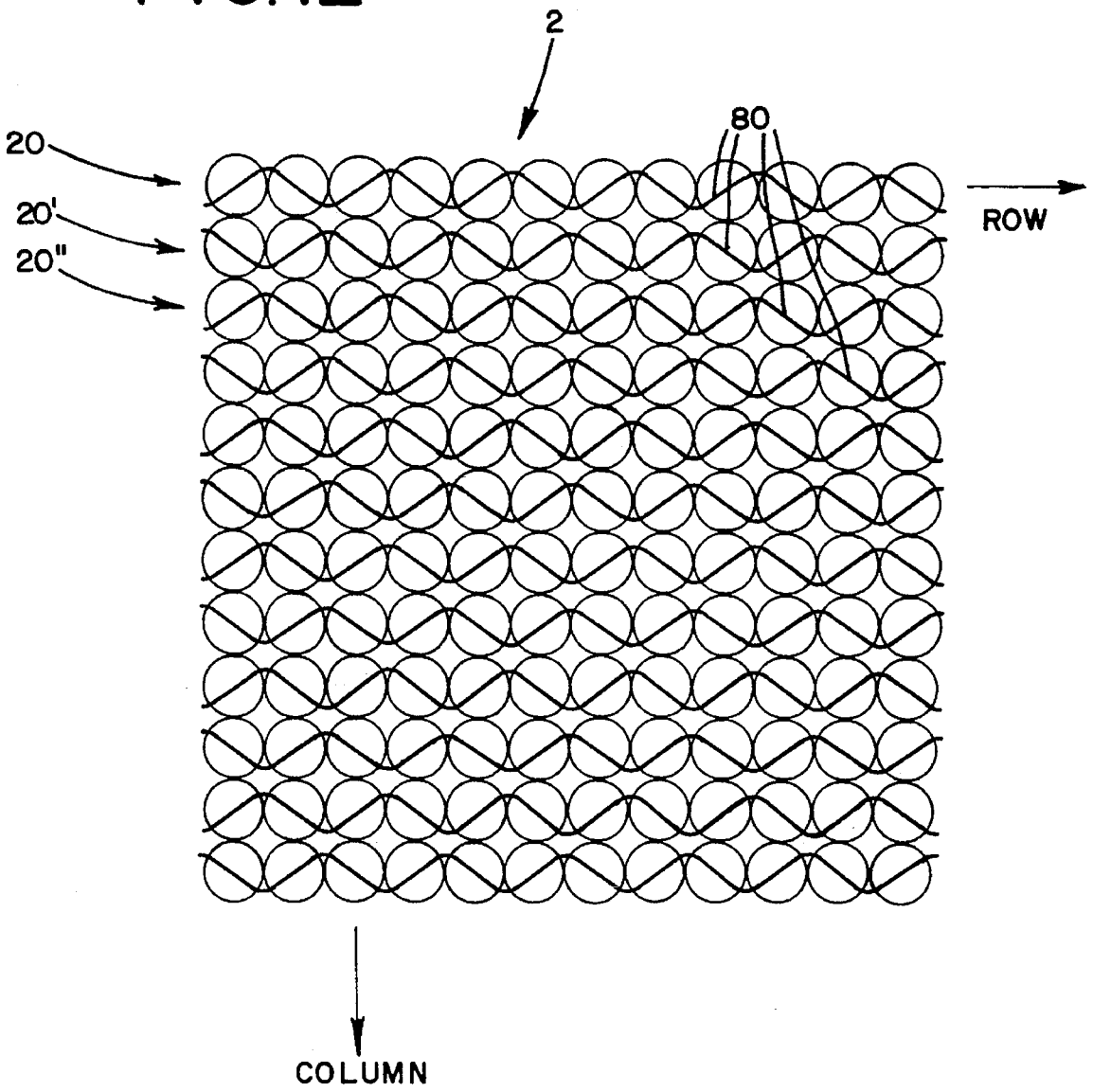
FIG. 12 is a top plan view of another embodiment of the innerspring constructions according to the present invention with the top or "longitudinal" seams of adjacent rows of pocketed spring coils aligned in a repetitive zig-zag configurations and with adjacent ones of the pocketed coils in the rows arranged for attachment in a "belly to belly" manner as illustrated in FIGS. 1–4.
Figure 13:
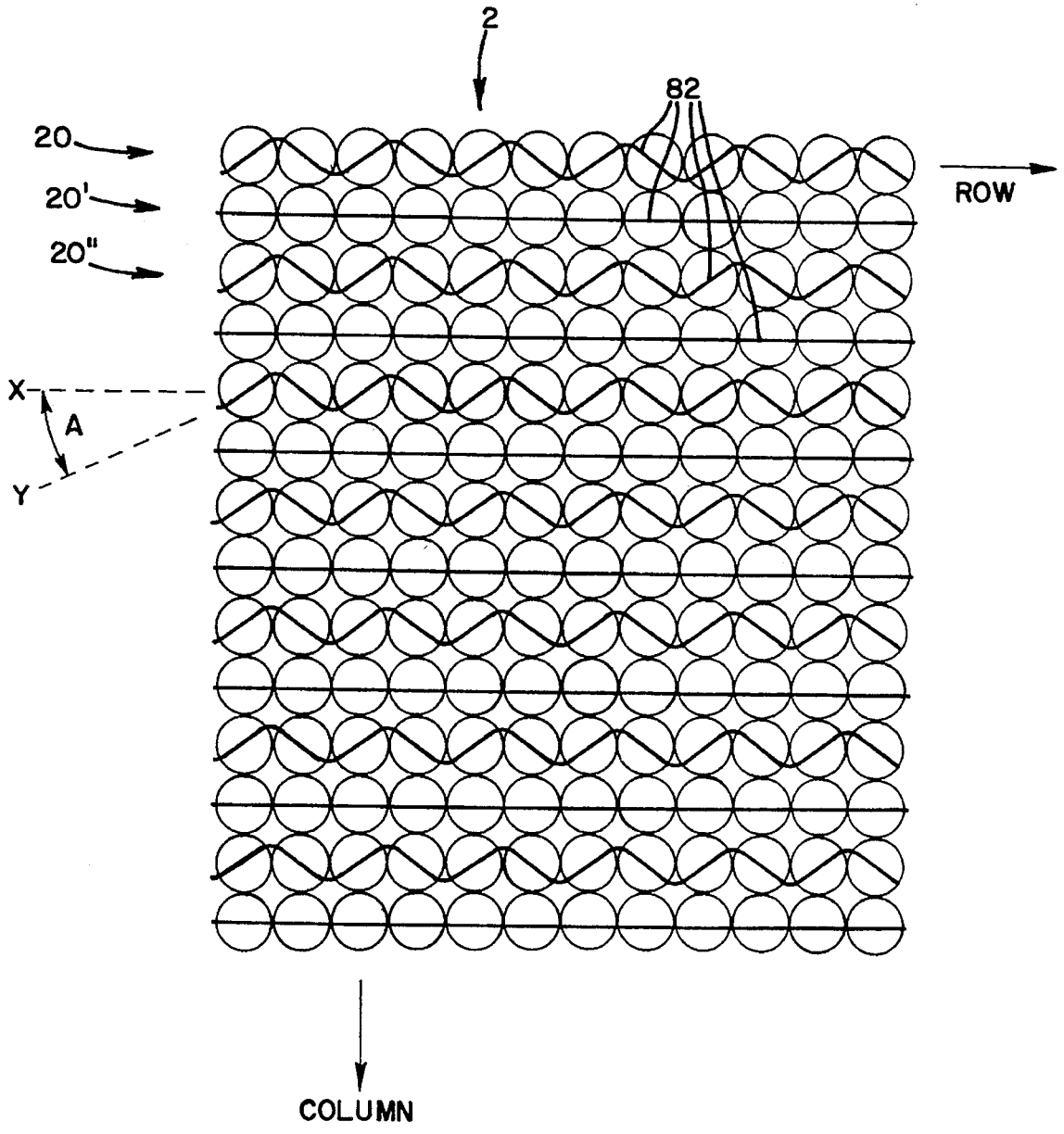
FIG. 13 is a top plan view of a further embodiment of the innerspring constructions according to the present invention with the top or "longitudinal" seams of of every other row of pocketed spring coils aligned in zig-zag configuration and the alternating rows having the seams of the pocketed coils arranged in an essentially planar alignment pattern and with adjacent ones of the pocketed coils in the rows arranged for attachment in a "belly to belly" manner in accordance with the attachment procedure illustrated in FIGS. 1–4 and 12.

With reference to FIGS. 12 and 13, it should be noted that although dimensional properties may vary, the offset "zig-zag" or "Quad" string configuration 80 shown in FIG. 12 and the alternating patterned string configuration 82 shown in FIG. 13 may also be constructed in accordance with the present invention in addition to the repeating "zig-zag" or "Chevron" pattern 84 shown in FIG. 1. It should be understood that to provide a configuration such as shown in FIG. 12, every string would have to be "jogged" one coil width relative to a previous coil string. This could be done by the use of two alternately indexed harp sets being offset one coil size to each other. With regard to the construction illustrated in FIG. 13, an alternative apparatus would be required to allow for ease of production of the alternating Rows of "zig zag" and straight alignment with the attacment bonding between adjacent pocketed coils 11 in consecutive, adjacent string Rows.

While this invention has been described in specific detail with reference to the disclosed embodiments, it will be understood that many variations and modifications may be effected within the spirit and scope of the invention as described in the appended claims. For example, there is no requirement that the invention be limited to the use of ultrasonically welded coil strings; seam sewing or other attachment may also be used. Also, it should be noted that the apparatus 10 may be used with manual feed by an operator, or by automatic feed. Coil strings from differing coilers may also be used, such as to provide a mattress having firmer edges by the use of firm coil springs at the appropriate edge locations.

What is claimed is:

1. An innerspring construction, comprising:

a first elongate string of pocketed coils including a plurality of individual spaced-apart spring coils, each coil having a longitudinal axis lying substantially in a first plane and a first elongate tube of fabric having first transverse seams spaced along the length of said tube to define individual coil pockets corresponding to and containing individual ones of said spring coils, said tube being alternately bent proximate said first seams such that every other first seam lies on the same side of said first plane; and a second elongate string of pocketed coils including a plurality of individual spaced-apart spring coils, each coil having a longitudinal axis lying substantially in a second plane and a second elongate tube of fabric having second transverse seams spaced along the length of said tube to define individual coil pockets corresponding to and containing individual ones of coils;

said second elongate string of pocketed coils being attached to said first elongate string of pocketed coils by bonds formed between circumferentially abutting surfaces on said coil pockets in said first and second elongate tubes of fabric.

2. The innerspring construction as claimed in claim 1, wherein said second elongate tube of fabric is alternately bent proximate said second seams such that every other second seam lies on the same side of the second plane.

3. The innerspring construction as claimed in claim 1 wherein said bond is formed by discrete deposits of adhesive.

4. The innerspring construction as claimed in claim 1 wherein each of said coil pockets in said second elongate tube of fabric is bonded to each adjacent one of said coil pockets in said first elongate tube of fabric.

5. The innerspring construction as claimed in claim 1 wherein said seams are thermally welded by ultrasonics.

6. The innerspring construction as claimed in claim 3 wherein said adhesive is hot-melt glue.

7. The innerspring construction as claimed in claim 1 wherein said pocketed coils are in contact in a belly-to-belly fashion.

8. The innerspring construction as claimed in claim 1 wherein said bonds are provided by hot-melt glue.

9. The innerspring construction as claimed in claim 2 wherein said pocketed coils are in contact in a belly-to-belly fashion.

10. An innerspring construction, comprising:

a first elongate string of pocketed coils itself comprising a plurality of individual spaced-apart spring coils having longitudinal axes all lying substantially in a first plane;

an elongate tube of fabric having substantially straight transverse seams spaced along the length of said tube to define individual coil pockets corresponding to and containing said individual coils, said tube being alternately bent approximate the locations of said seams such that every other seam lies on the same side of said first plane; and a second elongate string of pocketed coils attached to said first elongate string of pocketed coils by discrete deposits of adhesive forming bonds between circumferentially abutting surfaces on said coil pockets in said first and second elongate strings such that the general longitudinal axis of said first string is substantially parallel to the general longitudinal axis of said second string.

11. The innerspring construction as claimed in claim 10 wherein successive of said coil planes intersect said first plane in a zig-zag manner.

12. The innerspring construction as claimed in claim 11 wherein said seams are thermally welded by ultrasonics.

13. The innerspring construction as claimed in claim 12 wherein said adhesive is hot-melt glue.

14. The innerspring construction as claimed in claim 13 wherein said pocketed coils are in contact in a belly-to-belly fashion.

15. The innerspring construction as claimed in claim 10 wherein said seams are thermally welded by ultrasonics.

16. The innerspring construction as claimed in claim 15 wherein said adhesive is hot-melt glue.

17. The innerspring construction as claimed in claim 16 wherein said pocketed coils are in contact in a belly-to-belly fashion.

* * * * *